US005345647A

United States Patent [19]

Liu

[11] Patent Number: 5,345,647

[45] Date of Patent: Sep. 13, 1994

[54] TOOTHBRUSH

[76] Inventor: Hung-Hsi Liu, 808 Muddy Branch Rd., Gaithersburg, Md. 20878

[21] Appl. No.: 89,184

[22] Filed: Jul. 12, 1993

[51] Int. Cl.[5] ..... A46B 9/04; A46B 5/00

[52] U.S. Cl. ..... 15/207.2; 15/143.1; 15/167.1; D4/104

[58] Field of Search ..... 15/167.1, 143.1, 167.2, 15/DIG. 5, 207.2; D4/104

[56] References Cited

U.S. PATENT DOCUMENTS

| | | | |
|---|---|---|---|
| D. 110,185 | 6/1938 | Lukenbill | D4/104 |
| D. 140,438 | 2/1945 | Cohen | D4/104 |
| D. 163,707 | 6/1951 | Pifer | D4/104 |
| D. 231,872 | 6/1974 | Spaulding | D4/104 |
| D. 268,795 | 5/1983 | Ohama | D4/104 |
| 1,369,966 | 3/1921 | Cosens et al. | 15/143.1 |
| 2,040,245 | 5/1936 | Crawford | 15/167 |
| 2,230,171 | 1/1941 | Vorhees et al. | 15/167.1 |
| 2,272,151 | 2/1942 | Hertzberg | 15/143.1 |
| 2,511,235 | 6/1950 | Arwood | 15/167.1 |
| 2,567,080 | 9/1951 | Pifer | 15/167.1 |
| 2,620,500 | 12/1952 | Ridner, Sr. | 15/167.1 |
| 3,067,446 | 12/1962 | McGauley | 15/143.1 |
| 4,010,509 | 3/1977 | Huish | 15/167.1 |
| 4,115,894 | 9/1978 | Peterson | 15/167.1 |

FOREIGN PATENT DOCUMENTS

| | | | |
|---|---|---|---|
| 741585 | 11/1943 | Fed. Rep. of Germany | 15/167.1 |

*Primary Examiner*—David A. Scherbel
*Assistant Examiner*—Tony G. Soohoo
*Attorney, Agent, or Firm*—Roylance, Abrams, Berdo & Goodman

[57] ABSTRACT

A toothbrush for cleaning the lingual areas of the teeth while the user's mouth is substantially closed. The toothbrush includes a flat, wide connecting portion extending between the handle portion and the head portion of the toothbrush. The connecting portion allows the user to substantially close his mouth during brushing of the lingual areas of the teeth. The toothbrush is also provided with bristles extending outwardly to form a wide brushing area for simultaneously cleaning the upper and lower teeth.

11 Claims, 1 Drawing Sheet

FIG. 1
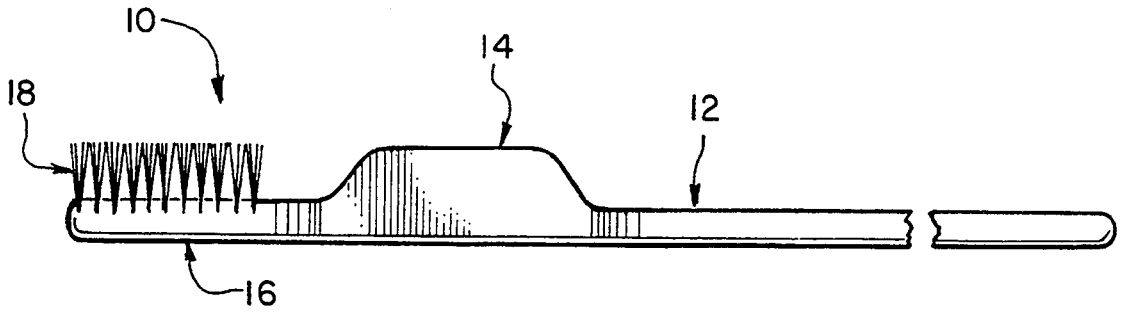
FIG. 2
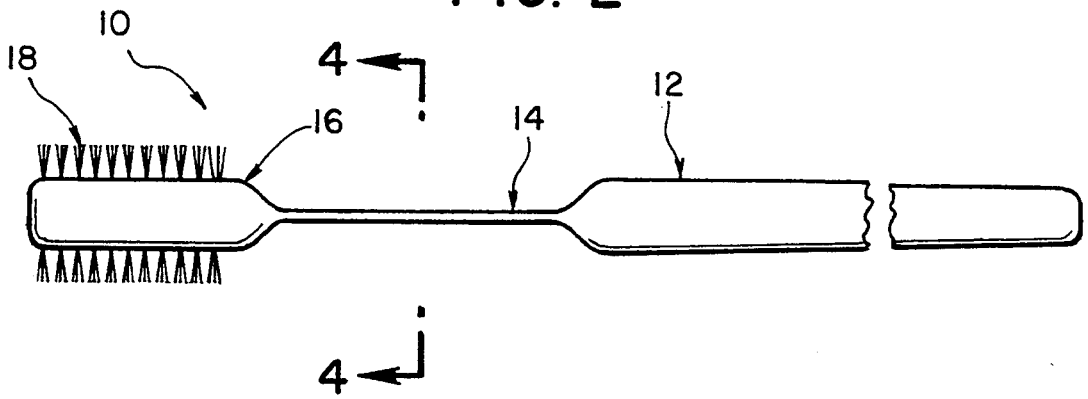
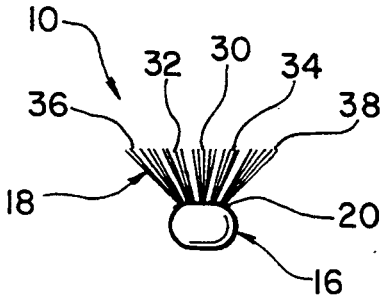
FIG. 3
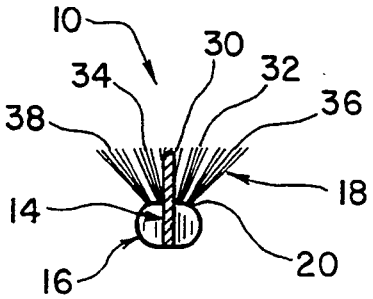
FIG. 4

TOOTHBRUSH

FIELD OF THE INVENTION

The present invention relates to toothbrushes for cleaning teeth and gums. More specifically, this invention relates to a toothbrush for cleaning of the lingual areas of the tooth as well as permitting simultaneous cleaning of the upper and lower teeth.

BACKGROUND OF THE INVENTION

Both adults and youths tend to neglect brushing their teeth or improperly brush their teeth. In fact, most people do not spend enough time brushing their teeth and often miss brushing their teeth between meals. Even those who are diligent in habitually brushing can actually cause gum damage and enamel erosion through incorrect brushing technique. Accordingly, toothbrushes are continuously being redesigned to clean teeth and gums more efficiently and effectively.

Typically, most people brush their teeth by holding the toothbrush so that the bristles engage their teeth at a substantially ninety degree angle, and then proceed to brush either up or down, sidewise, and/or in a circular motion. Since the bristles of the toothbrush extend substantially perpendicular from the head of the toothbrush and also engage the persons teeth at a ninety degree angle, very little cleaning takes place on the sulcular level. Thus, plaque causing bacteria may not be removed and may even result in plaque buildup. Plaque bacteria is a major cause of periodontal or gum disease.

Some examples of prior toothbrushes are disclosed in U.S. Pat. Nos.: Des. 110,185 to Lukenbill; Des. 140,438 to Cohen; Des. 168,707 to Pifer; 2,040,245 to Crawford; 2,511,235 to Arwood; 2,567,080 to Pifer; 4,010,509 to Muish; and 4,115,894 to Peterson. None of the prior brush designs permit comfortable simultaneous cleaning of the upper and lower teeth. The larger handle designs required users to open their mouths uncomfortably wide to accommodate the handle of the toothbrush which unfortunately serves to increase the distance between the upper and lower teeth. This problem has resulted in toothbrushes which use a larger head and bristle design further reducing the user's comfort.

In view of the above, it is apparent that there exists a need for a toothbrush which more efficiently and effectively cleans teeth. This invention addresses this need in the art along with other needs which will become apparent to those skilled in the art once given this disclosure.

SUMMARY OF THE INVENTION

A primary object of the present invention is to provide a toothbrush which efficiently and effectively cleans teeth and gums as well as in between teeth.

Another object of the present invention is to provide a toothbrush which increases the effectiveness of the bristles to brush the plaque near the gingival area.

Another object of the present invention is to provide a toothbrush designed to simultaneously brush the upper and lower teeth.

Still another object of the present invention is to provide a toothbrush in which the bristles will enter the sulcus area to remove plaque.

Yet a further object of the present invention is to provide a toothbrush that will save brushing time and remove more plaque.

A further object of the present invention is to provide a toothbrush which can brush the lingual surfaces while the user's mouth is substantially closed.

The foregoing objects are basically attained by a toothbrush for cleaning teeth and gums, comprising: an elongated handle portion having a predetermined length extending longitudinally in a first direction, a predetermined width extending in a second direction substantially perpendicular to the first direction, and a predetermined thickness extending in a third direction substantially perpendicular to the first and second directions: a connecting portion integrally coupled to the handle portion, and having a relatively thin thickness extending in the second direction and a relatively wide width extending in the third direction, the thickness of the connecting portion being less than the width of the handle portion, and the width of the connecting portion being greater than the thickness of the handle portion; and a head portion integrally coupled to the connecting portion, the head portion having bristles extending outwardly from the head portion.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this original disclosure:

FIG. 1 is a side elevational view of a toothbrush in accordance with the present invention;

FIG. 2 is a bottom plan view of the toothbrush illustrated in FIG. 1;

FIG. 3 is a left end elevational view of the toothbrush illustrated in FIGS. 1 and 2; and FIG. 4 is a cross-sectional view of the toothbrush illustrated in FIG. 3 taken along section lines 4—4.

DETAILED DESCRIPTION OF THE DRAWINGS

Referring to the figures, a toothbrush 10 in accordance with the present invention for cleaning teeth and gums is illustrated. Toothbrush 10 includes an elongated handle portion 12, a relatively thin, flat connecting portion 14 integrally coupled to elongated handle portion 12, and a head portion 16 with a plurality of bristles 18 extending outwardly therefrom. Preferably, elongated handle portion 12, connecting portion 14 and head portion 16 are formed together as a unitary, one-piece, integral member molded out of a substantially rigid, hard plastic material. Of course, any suitable material currently being used to form toothbrush handles can be used in forming toothbrush 10. Moreover, connecting portion 14 may have a reinforcing member (shown), embedded therein for additional strength. Of course, such a reinforcing member would extend at least partially into handle portion 12 and head portion 16.

Handle portion 12 preferably is an elongated member having a rectangular cross section with a length ranging from approximately three inches to five inches, a width ranging from approximately one-quarter of an inch to approximately one-half of an inch, and a thickness of approximately one-eighth of an inch to approximately one-quarter of an inch. It will be apparent to those skilled in the art once given this disclosure that handle portion 12 can have a variety of shapes including any shape which is presently available for toothbrushes.

Connecting portion 14 is preferably a wide, substantially flat area having a thickness of approximately one-sixteenth of an inch or less. While connecting portion 14 is illustrated as having a uniform thickness, it will be apparent from this disclosure that the transition between the handle portion 12 and the connecting portion 14 as well as the transition between the head portion 16 and the connecting portion 14 can be thicker for added strength so that connecting portion 14 has a uniform thickness in between the two transition areas.

Connecting portion 14 preferably has a trapezoidal shape with a longitudinal length ranging from approximately one inch to approximately two and one-quarter inches. Of course, connecting portion 14 can have a variety of wide, substantially flat shapes. In particular, the longer portion of connecting portion 14 lies along the longitudinal axis of handle portion 12, and connects handle portion 12 with head portion 16. The shorter portion of connecting portion 14 extends outwardly from handle portion 12. Preferably, the width of connecting portion 14 is approximately three-quarters of an inch. Of course, the width of connecting portion 14 can range from approximately one-half inch to one inch depending on the particular shape of the toothbrush 10.

Since connecting portion 14 is a relatively wide, flat thin area, the user can get between the occlusal surfaces for lingual brushing. In particular, during lingual brushing, the user can keep his mouth slightly open to clear the wide flat connecting portion 14 to guide over the occlusal surfaces of the teeth. Thus, the occlusal surfaces of the teeth act as a guide for the connecting portion 14 of the toothbrush 10 so as to allow smooth brushing strokes during brushing of either the inner or outer surfaces of the teeth.

Head portion 16 has preferably a width of approximately three-eights of an inch to approximately one-half inch, a length ranging between approximately 1.0 inch to 1.5 inches, and a thickness of approximately one-eighth of an inch to approximately one quarter of an inch. Head portion 16 preferably has a curved bristle surface 20 with bristles 18 extending outwardly therefrom. Bristles 18 can be secured to head portion 16 in any known manner. Accordingly, the precise means for attaching bristles 18 to head portion 16 is well known in the prior art and will not be discussed in detail herein. Head portion 16 preferably has a curved bristle surface 20 with bristles 18 extending outwardly therefrom. Bristles 18 may be of any desired type and are preferably relatively soft, polished nylon bristles with rounded tips. Bristles 18 are preferably arranged in five rows of bristles with the first row of bristles 30 extending substantially perpendicular to the head portion 16 and substantially parallel to the width of connecting portion 14. The second row of bristles 32 extends outwardly from head portion 16 and form approximately a 15.0 to 22.5 degree angle with the first row of bristles 30. Similarly, third row of bristles 34 extends outwardly from head portion 16 and forms approximately a 15.0 to 22.5 degree angle with first row of bristles 30. The fourth row of bristles 36 extends outwardly from head portion 16 and form approximately a 30 to 45 degree angle with first row of bristles 30. The fifth row of bristles 38 extends outwardly from head portion 16 and forms approximately a 30 to 45 degree angle with first row of bristles. Within each row of bristles, there are preferably tufts of bristles with the tufts of bristles being staggered relative to the tufts of bristles within adjacent rows of bristles.

While only one embodiment has been chosen to illustrate the invention, it will be understood by those skilled in the art that various changes and modifications can be made herein without departing from the scope of the invention as defined in the appended claims.

What is claimed is:

1. A toothbrush for cleaning teeth and gums, comprising:

an elongated handle portion having a first free end and a second end with a predetermined length extending longitudinally in a first direction between said first and second ends of said handle portion, a predetermined width extending in a second direction substantially perpendicular to said first direction, and a predetermined thickness extending in a third direction substantially perpendicular to said first and second directions;

a substantially flat connecting portion having a first end and a second end with said first end of said connecting portion being integrally coupled to said second end of said handle portion, and having a predetermined longitudinal length extending at least approximately one inch in said first direction, a predetermined thickness extending at least approximately no greater than one-sixteenth of an inch in said second direction and a predetermined width extending at least approximately one-half inch in said third direction, said thickness of said connecting portion being less than said width of said handle portion, and said width of said connecting portion greater than said thickness of said handle portion; and a head portion having a first end and a second free end with said first end of said head portion being integrally coupled to second end of said connecting portion, said head portion having bristles extending outwardly generally in said third direction from said head portion so that said predetermined width of said connecting portion extends substantially in the same direction as said bristles of said head portion.

2. A toothbrush according to claim 1, wherein said bristles are arranged to include at least three rows of bristles with a first row of bristles extending substantially perpendicular to said head portion, a second row of bristles extending at an acute angle relative to said first row of bristles, and a third row of bristles extending at an acute angle relative to said first row of bristles.

3. A toothbrush according to claim 2, wherein said bristles are further arranged to include a fourth row of bristles extending at an acute angle to said first row of bristles, and a fifth row of bristles extending at an acute angle to said first row of bristles.

4. A toothbrush according to claim 3, wherein said second and third rows of bristles form approximately 15 to 22.5 degree angles with said first row of bristles.

5. A toothbrush according to claim 4, wherein said fourth and fifth rows of bristles form approximately 30 to 45 degree angles with said first row of bristles.

6. A toothbrush according to claim 5, wherein said thickness of said connecting portion is approximately one-sixteenth of an inch.

7. A toothbrush according to claim 6, wherein said connecting portion has a length extending in said first direction approximately one inch to approximately two inches.

8. A toothbrush according to claim 1, wherein said connecting portion has a width of approximately three-quarters of an inch.

9. A toothbrush for cleaning teeth and gums, comprising:

an elongated handle portion having a first free end and a second end with a predetermined length extending longitudinally in a first direction between said first and second ends of said handle portion, a predetermined width extending in a second direction substantially perpendicular to said first direction, and a predetermined thickness extending in a third direction substantially perpendicular to said first and second directions;

a substantially flat connecting portion having a first end and a second end with said first end of said connecting portion being integrally coupled to said second end of said handle portion, and having a uniform thickness of approximately one-sixteenth of an inch extending in said second direction, a width extending in said third direction a greater distance than said thickness of said handle portion and a length extending in said first direction approximately one and one-half inches to approximately two and one-quarter inches, said thickness of said connecting portion being less than said width of said handle portion; and a head portion having a first end and a second free end with said first end of said head portion being integrally coupled to said second of said connecting portion, said head portion having bristles extending outwardly generally in said third direction from said head portion so that said predetermined width of said connecting portion extends substantially in the same direction as said bristles of said head portion.

10. A toothbrush according to claim 9, wherein said bristles are arranged to include at least three rows of bristles with a first row of bristles extending substantially perpendicular to said head portion, a second row of bristles extending at an acute angle relative to said first row of bristles, and a third row of bristles extending at an acute angle relative to said first row of bristles.

11. A toothbrush according to claim 9, wherein said width of said connecting portion extending approximately three-quarters of an inch in said third direction.

* * * * *